United States Patent [19]

Seaton

[11] Patent Number: 5,056,584

[45] Date of Patent: Oct. 15, 1991

[54] METHOD OF AND APPARATUS FOR POURING MOLDS ON A CONTINUOUSLY MOVING CONVEYOR

[75] Inventor: Williams W. Seaton, Dexter, Mich.

[73] Assignee: CMI International, Inc., Southfield, Mich.

[21] Appl. No.: 447,192

[22] Filed: Dec. 7, 1989

[51] Int. Cl.[5] ..... B22D 39/00; B22D 46/00

[52] U.S. Cl. ..... 164/457; 164/130; 164/136; 164/155; 164/323; 164/337

[58] Field of Search ..... 164/4.1, 457, 130, 154, 164/155, 136, 323, 337

[56] References Cited

U.S. PATENT DOCUMENTS

| | | | |
|---|---|---|---|
| 1,747,728 | 2/1930 | Morris et al. | 164/155 X |
| 3,435,882 | 4/1969 | Falk | 164/323 |
| 3,537,489 | 11/1970 | Hall | 164/155 X |
| 4,168,739 | 9/1979 | Smith et al. | 164/155 |
| 4,230,308 | 10/1980 | Gueguen | 164/155 X |
| 4,549,600 | 10/1985 | Kauserud | 164/323 |
| 4,557,313 | 12/1985 | Navarre | 164/155 |
| 4,724,894 | 2/1988 | Sjodahl | 164/457 |
| 4,744,407 | 5/1988 | Fishman et al. | 164/457 |

FOREIGN PATENT DOCUMENTS

| | | | |
|---|---|---|---|
| 55-133865 | 10/1980 | Japan | 164/154 |
| 56-56772 | 5/1981 | Japan | 164/155 |

*Primary Examiner*—J. Reed Batten, Jr.

*Attorney, Agent, or Firm*—Harness, Dickey & Pierce

[57] ABSTRACT

A system for pouring molds on a continuously moving conveyor by an automated process has an apparatus positioned over a moving conveyor including a plurality of molds. The apparatus includes a frame adapted to be positioned over the moving conveyor. The apparatus includes a mechanism for moving the frame in a reciprocating forward and reverse direction along a path defined by the conveyor. The apparatus includes a mechanism to pour molten metal into the plurality of molds on the conveyor. The pouring mechanism is associated with the frame such that the pouring mechanism moves at a speed substantially equal to the speed of the conveyor to enable filling of the plurality of molds as the molds continue to move on the conveyor.

17 Claims, 6 Drawing Sheets

METHOD OF AND APPARATUS FOR POURING MOLDS ON A CONTINUOUSLY MOVING CONVEYOR

BACKGROUND OF THE INVENTION

The present invention relates to mold castings and, more preferably, to a movable system pouring casting molds on a car type mold conveyor.

In the foundry industry, iron ore, scrap or the like is melted into a molten state where it is poured into molds to form metal castings. Generally, an impression of the element to be cast is formed in a sand mold. The sand molds include pouring basins to enable passage of the molten metal into the cavity impression within the sand mold.

During the pouring or casting process, the sand molds are positioned onto a car type mold conveyor and the conveyor is activated moving the molds along it. The conveyor is indexed such that it stops for a desired amount of time before starting. As the molds move along the conveyor, at each indexing of the conveyor, an operator fills each mold individually from a large ladle containing as much as a ton of molten metal. The ladle is generally hung overhead on swivels and pivots to enable the operator to pour it. This process requires the operator to be skilled in moving and pouring the ladle.

The above presents the art with several disadvantages. One disadvantage is that the pouring of the mold is operator-dependent. The consistency of the molds varies due to the pouring of the operator. The operator is subjected to very hot conditions during continuous pouring of the molds. There are known automatic and semi-automatic stopper pouring systems that pour stationary molds. These systems require the mold line to be moved or indexed forward one mold at a time to enable the systems to pour the molds. The stopping and starting of the indexing conveyor with a multiplicity of molds thereon, due to the exceptionally large load carried by the conveyor, causes exceptional wear on the conveyor in a very short period of time. Accordingly, it is desirous to provide an apparatus which overcomes these disadvantages and pour molds on a continuously moving mold line.

SUMMARY OF THE PRESENT INVENTION

The present invention provides the art with a stopper pouring system, whereas a stopper ladle is positioned above a car type mold conveyor and travels along with the mold conveyor, pouring molds thereon.

The invention provides a pouring system which is in synchronized movement with the conveyor such that the molds are consistently poured.

The present invention provides a system which may be controlled by a programmable controller to improve the quality of the castings.

The present invention provides a system which is adjustable in both longitudinal and lateral directions to compensate for the location of the pouring basin on top of the moving mold.

The present invention substantially eliminates the need for stopping of the conveyor during filling of the molds.

From the following detailed description taken in conjunction with the accompanying claims and drawings, other objects and advantages of the present invention will become apparent to those skilled in the art.

DETAILED DESCRIPTION OF THE PREFERRED EMBODIMENT OF THE PRESENT INVENTION

Figure 1:
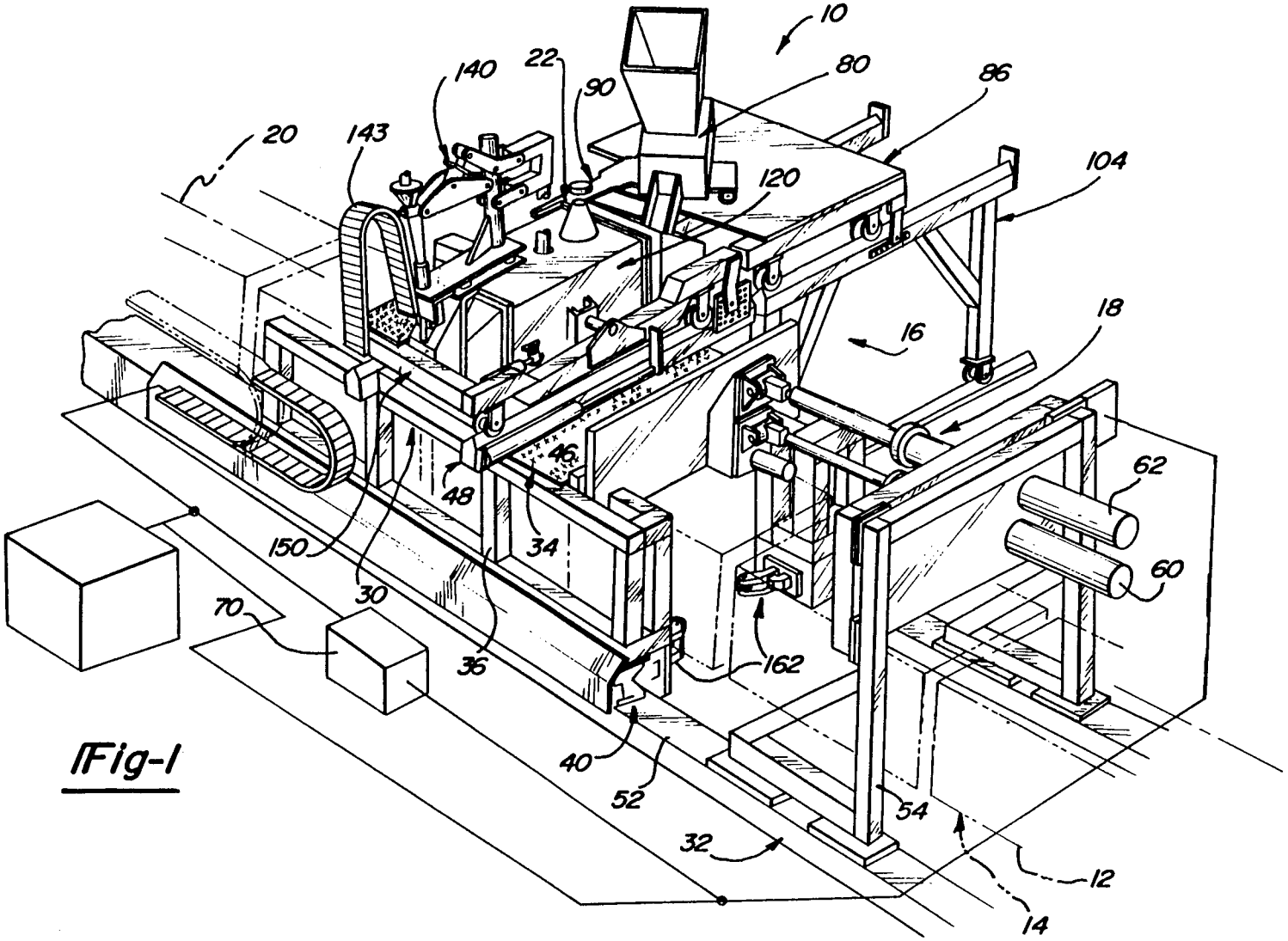
FIG. 1 is a perspective view of an apparatus for pouring molds on a moving conveyor in accordance with the present invention.

Turning to the figures, particularly FIG. 1, an apparatus for pouring molten metal into molds 12 on a moving conveyor 14 has been designated with the reference numeral 10. The pouring apparatus 10 generally includes a frame structure 16 positioned over the moving car type mold conveyor 14 with its plurality of molds 12. A movement mechanism 18 is associated with the frame 16 to reciprocate the frame 16 in a forward and reverse direction along an axis 20 of the path defined by the conveyor 14. A mechanism 22 to pour molten metal into the plurality of molds 12 is associated with the frame 16.

Figure 3:
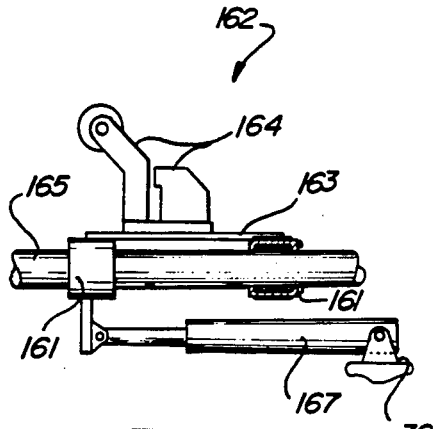
FIG. 3 is an enlarged top elevation view of FIG. 2 within circle 3.

The frame member 16 includes a movable gantry 30 and a stationary member 32. The gantry 30 includes a deck 34 and a pair of side members 36. The deck 34 and side members 36 form an inverted U-shape when viewed in end elevation, as seen in FIG. 3. The gantry 30 is formed from a truss construction. The side members 36 ordinarily include shields (not shown) to prevent splashing of the molten material.

Figure 4:
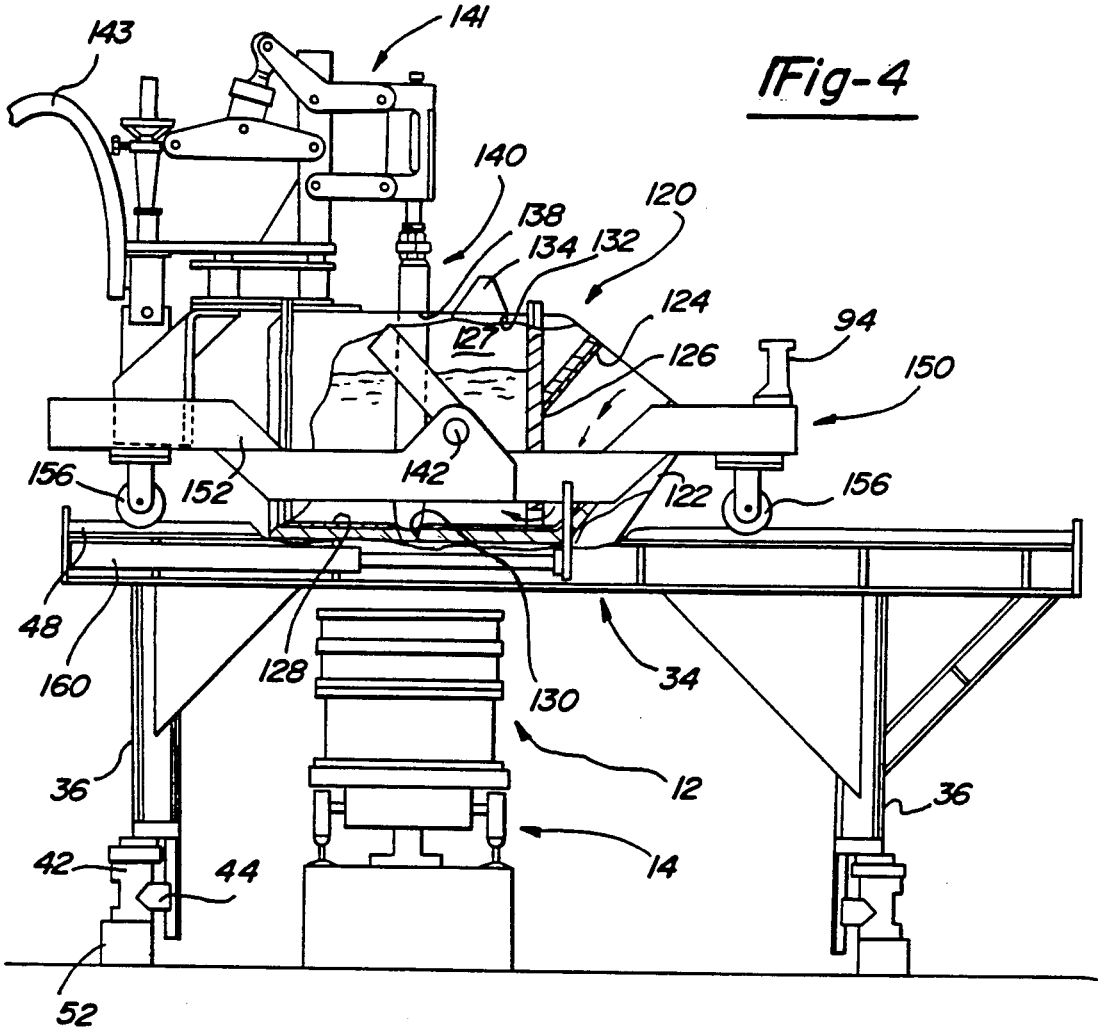
FIG. 4 is an end elevation view of the apparatus of FIG. 1 illustrating the conveyor passing under the apparatus.
Figure 6:
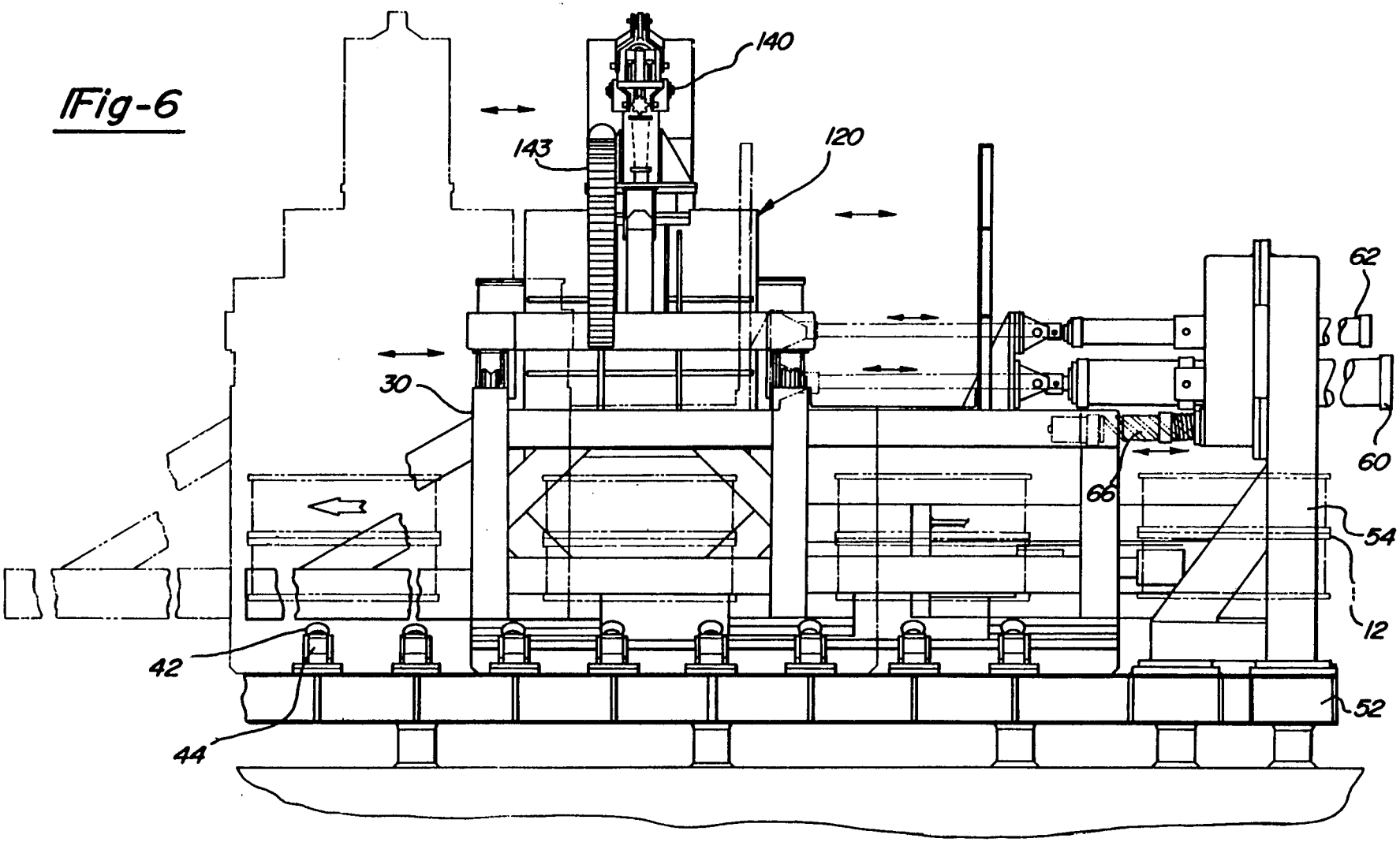
FIG. 6 is a side elevation view of the apparatus of FIG. 1.

A rolling mechanism 40 is associated with each of the ends of the side members 36 to provide movement of the gantry 30 on the stationary member 32. A rail 42 and roller 44 arrangement (FIG. 6) is provided on the stationary member 32 and gantry side members 36, as seen in FIGS 1, 4 and 6. The rollers 44 may be either on the stationary member 32 or the gantry side members 36 and, likewise, the rail 42 may be on either of the members. The gantry 30 rolls along either the rail 42 or rollers 44 to provide movement along the path of the car type mold conveyor 14, as best seen in FIGS. 1, 4 and 6.

The deck 34 includes catwalks 46 to enable service technicians to service the gantry 30 and associated elements. Also, a rail device 48 is positioned on the deck 34 to enable transverse movement of the pouring mechanism 22 with respect to the axis of the conveyor 14, as will be described herein.

The stationary member 32 of the frame 16 generally is L-shaped, having elongated tracks 52 to support either the rollers 44 or the rail 42 for movement of the gantry 30. A projecting support 54, forming the vertical portion of the L, is secured to the track members 52 to provide a stationary support to mount the movement mechanism 18 thereon.

The movement mechanism 18 includes one or more cylinders 60 and 62 to move the gantry 30 in a reciprocating forward and reverse direction along the tracks 52 of the stationary member 32 of the frame 16. An air cylinder 60 is utilized for both forward and reverse movement of the gantry 30 along the rail 42 and roller 44 arrangement on tracks 52. A hydraulic cylinder 62 is utilized to control the speed of the gantry 30 in both forward and reverse directions as the gantry 30 moves along the tracks 52. Various other types of cylinders or the like drives, such as chain and sprocket, gear trains, belts or air motors may be utilized to move the gantry 30 along the rail 42 and roller 44 arrangement on the tracks 52.

A shock absorber 66 is connected with the frame member support 54 to slow movement of the gantry 30 on its return stroke. The cylinders have a control circuit including conduits, servo valves and the like, which are ultimately controlled by the controller 70.

The controller 70 is programmable so that the stroke of the cylinders ultimately moving the gantry 30 may be precisely controlled to enable synchronized movement of the gantry 30 with the conveyor 14. The controller 70 can be programmed to control the acceleration and deceleration of the gantry 30 to minimize wave motion of the liquid metal within the pouring mechanism 22.

Figure 2:
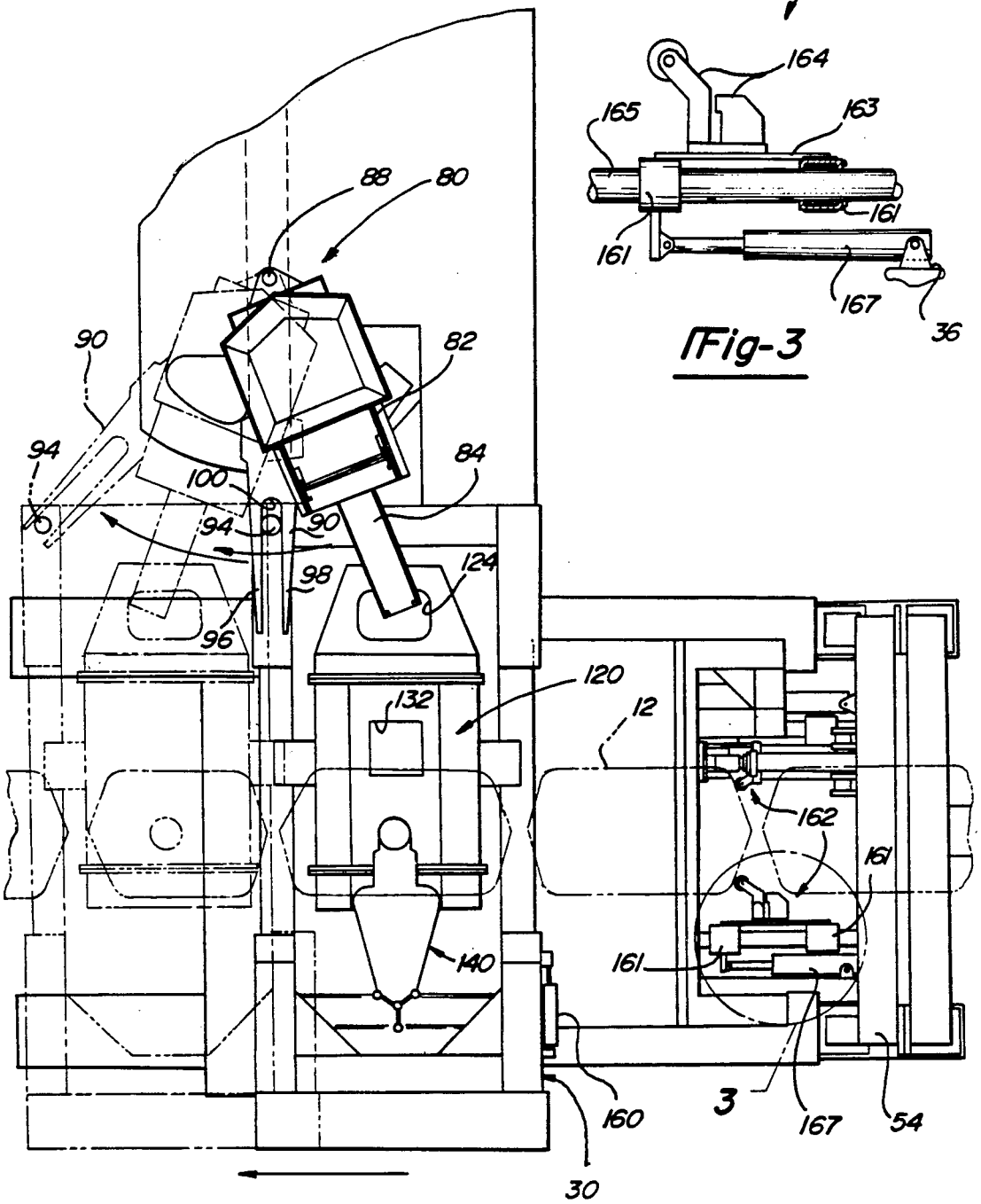
FIG. 2 is a top plan view of the apparatus of FIG. 1.

The pouring mechanism 22 includes a container 80 for receiving molten metal from a molten metal source and a ladle 120 to porr the molten metal into the molds 12. The container 80 and ladle 120 are generally fixedly secured with one another. In Figure 2, the receiving container 80 includes a box member 82 having a trough 84 extending therefrom. The box member 82 is secured to a rolling member 86 with a pivot 88. A yoke member 90 and roller member 92 are coupled with the box member 82 to provide reciprocating rotational movement of the box member 82 and trough 84 along an arc, as seen in FIG. 2. A pin 94, on the ladle carriage is positioned between the legs 96 and 98 of the yoke member 90 to restrict the reciprocating arcuate movement of the box member 82 and trough 84 to provide movement of the yoke slot 100 alonq the pin 94. As the boX member 82 pivots, the trough 84 moves with the ladle 120. The box member 82 (FIGS. 5*a* and 5*b*) is provided with a coupling 102 coupled with pivot 88 to enhance loading of the box member 82 with molten metal.

Figure 5A:
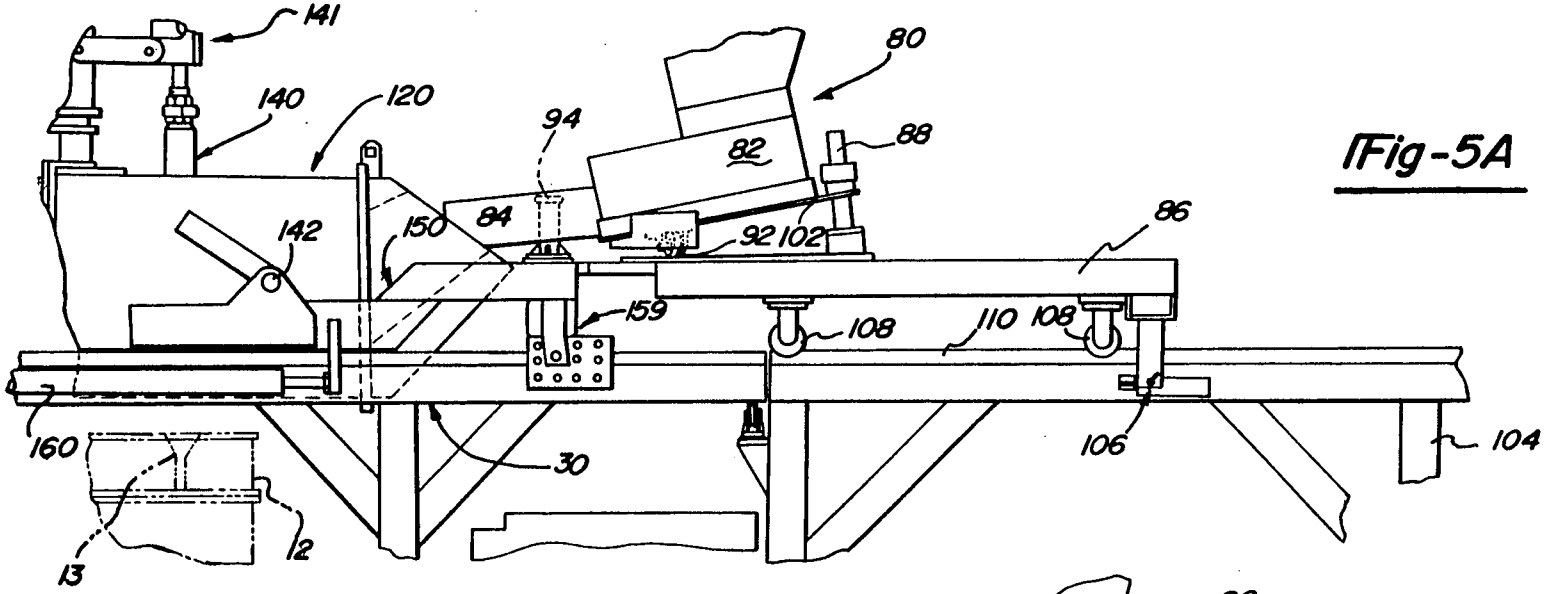
FIG. 5*a* is an end elevation view illustrating the pouring unit in a normal pouring position.
Figure 5B:
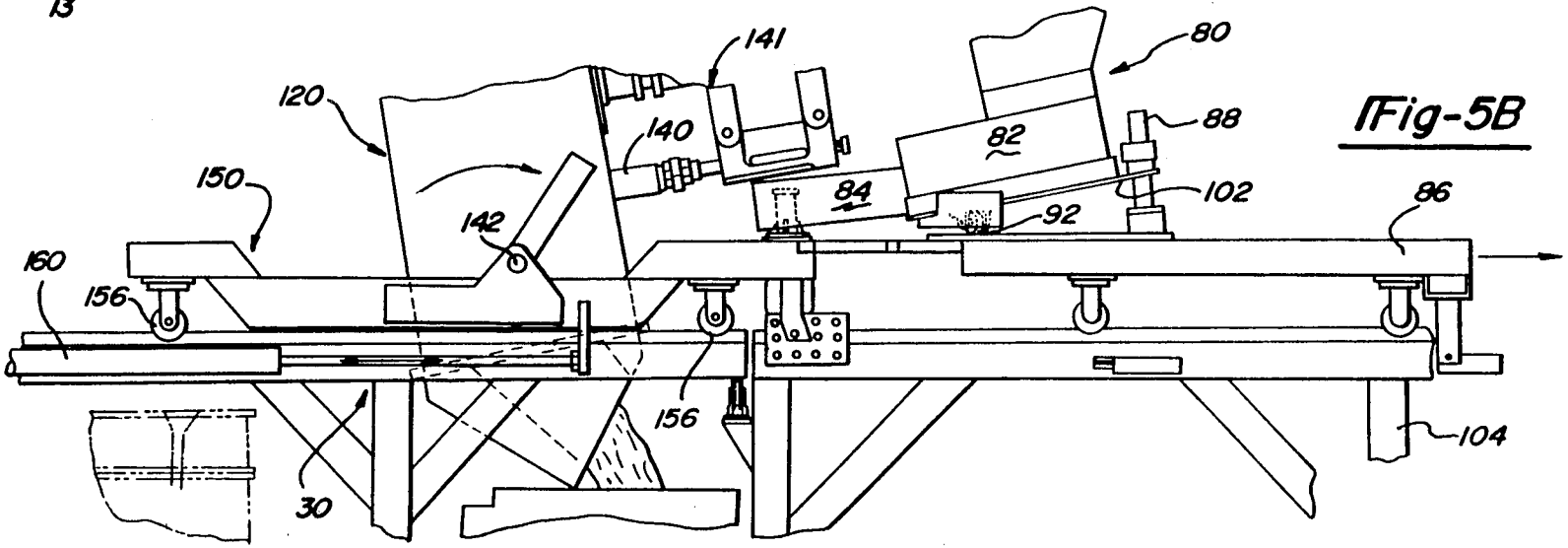
FIG. 5*b* is an end elevation view like that of FIG. 5*a* illustrating the ladle emptying into a refractory lined box.

The rolling carriage 86 which the box member is mounted on is removably secured to a support frame 104 by a locking pin arrangement 106. The support frame 104 is movable in a direction transverse to the axis of the conveyor 14. The rolling carriage 86 is unsecured from the support frame 104, via pin arrangement 106, to enable the container 80 and ladle 120 to be moved out of pouring engagement with the molds 12. The rolling carriage 86 includes wheels 108 coupled with rails 110 to provide transverse movement with respect to the axis of the conveyor of the container 80 and ladle 120, as seen in FIGS. 5*a* and 5*b*.

In FIG. 4, the ladle 120 has an overall rectangular box shape with a protruding side 122. The protruding side 122 includes a mouth opening 124 which enables the trough 84 to ride along with ladle 120 as the ladle 120 receives molten metal from the box member 82. The remainder of the ladle 120 is enclosed to conserve the molten metal temperature.

The ladle 120 includes a partition 126 to prevent atmospheric air and floating slag from entering into the refractory cavity 127 of the ladle 120. The. ladle 120 has an insulated interior formed from a ceramic material 128. The ladle 120 includes a ceramic nozzle 130 to enable the molten metal to flow from the ladle 120 into molds 12.

The stopper 140 is coupled with the ladle 120 by means of the stopper actuating mechanism 141. The coupling with the ladle 120 enables the stopper 140 to be raised to open the ceramic nozzle 130 to enable the molten metal to flow from th ladle 120 into molds 12. Also a power track 143 is coupled with the stopper mechanism 141 to provide linking of the stopper mechanism 141 with the controller 70 and power source.

The ladle 120 also has a port 132 coupled with a gas heating source I34 to enable preheating of the ladle 120 prior to the entrance of the molten metal and to optionally continue heating to maintain the temperature of the molten metal once the ladle is filled. A third port 138 is included in the ladle 120 to enable the stopper 140 to be positioned into the ladle 120. The ladle 120 is pivoted about trunnions 142 to enable dumping of the ladle 120 of excess molten metal, as illustrated in FIG. 5*b*. This enables the ladle 120 to be emptied upon halting of the process or for cleaning of the ladle 120.

The ladle 120 is positioned on a ladle carriage 150. The ladle carriage 150 includes an overall rectangular shaped frame 152 having the ladle 120 positioned within its boundary and secured thereto by trunnions 142. Wheels 156 associated with rails 48 on frame deck 34 are coupled with the frame 152 to provide movement of the carriage which, in turn, provides movement of ladle 120 in a direction perpendicular to the axis of the conveyor. Ladle frame 152 includes extending pin 94 associated with yoke member 90. A member secures the carriage frame 152 with the rolling member 86. Also, ladle frame 152 includes a pin arrangement 159 removably affixing the ladle carriage 150 to the gantry 30 during pouring of the molds. Other methods of removably affixing the ladle carriage to the gantry 30 includes digitally encoded hydraulic cylinders, levers and/or a chain driven by an encoded drive motor.

The stopper mechanism 141 is coupled with the controller 70 to raise the stopper 140 out of the nozzle 130 to enable the mold to be filled. The stopper mechanism 141 is like those disclosed in applicant,s previous U.S. Pat. Nos. 4,196,829; 4,271,994 and 4,155,492, the specifications of which are herein incorporated by reference.

A positioning cylinder 160 (FIG. 4) is coupled with the ladle carriage 150 to move the ladle 120 and carriage 86 supporting container 80 in a direction transverse with respect to the path of the conveyor 14. The wheels 156 on the ladle carriage 150 provide for such movement. The cylinder 160 is coupled with the controller 70 to adjust the ladle 120 position in a direction transverse to the axis of the conveyor path so that the ladle 120 may be positioned directly over the pouring basin 13 (FIG. 5*a*) of the mold 12 to compensate for off-axis misalignment of the molds 12. Also, if each mold 12 moving down the conveyor 14 has a pouring basin at a different position on the mold, this information would be programmed into the controller 70 so that the adjustment cylinder 160 would move the ladle 120 transversely with respect to the axis of the path of the conveyor 14 to enable the ladle 120 to pour into the pouring basin 13. Also, a position encoder may be provided to position the nozzle 130 above the pouring basin 1 of the mold 12. The positions of different pouring basins on different molds may be stored in memory by the controller 70 to enable recall by an identification mechanism to pour the different molds.

The gantry 30 includes a sensing mechanism 162 (FIG. 3) to determine the position of the molds 12 as they move underneath the gantry 30. The sensing mechanism 162 generally includes one or more switches 164 which determine when and where a mold is positioned on the conveyor 14 with respect to the gantry 30 and ultimately with the ladle 120. The sensing switches 164 are coupled with the controller 70 to provide information on the position of the molds 12. Once the sensing switches 164 have relayed information to the controller 70 to enable the controller 70 to determine that the molds are in line with the pouring nozzle 130 of the ladle 120, the gantry 30 begins to move along the conveyor 14 above the mold to be poured, the stopper actuating, mechanism 141 raises the stopper 140 which opens the nozzle 130 pouring molten metal from the ladle 120 into the pouring basin 13 of the mold 12. The movement of the gantry 30 is synchronized with the movement of the mold 12 so that they are moving at substantially the same speed as the mold is filled.

The sensing mechanism 162 (FIG. 3) also includes a pair of collars 161 and a plate 163 to enable mounting of the switches 164. The collars 161 are moveable along member 165 to adjust for axial misalignments. An adjustment cylinder 167, is coupled with support 36 and collar 161 to adjust for different placement of pouring basins on the molds. The adjustment cylinder 167 is associated with the controller 70 so that programmed information can be transmitted to the adjustment cylinder 167 to enable adjustment cylinder 167 to move the sensing mechanism 162 along the axis of the path of the conveyor 14 to enable the ladle 120 to pour into the pouring basin of the mold. The mold pouring basin locations can be programmed into the controller 70 so that the adjustment cylinders automatically adjust the ladle 120 to compensate for axial and off-axis misalignment so the nozzle 130 pours into the pouring basins of each different mold.

Also, the sensing mechanism 162 may utilize a plurality of different types of switches. The switches may include non-contact sensors, mechanical switches, light beams, infrared beams, laser beams or mechanical latching devices.

The controller 70, including electronic and hydraulic elements, which is coupled with the cylinders 62 and 64, sensing mechanism 162, ladle stopper mechanism 141 and positioning cylinders 160 and 167 through various power tracks is programmable so that the pouring of the molds may be accomplished by an automated process. The controller 70 is preprogrammed for each of the molds 12 to pass by the sensing mechanisms 162. As the particular mold approaches the pouring apparatus 10, the adjustment cylinders 160 and 167 would adjust the positions of the ladle 120 and sensing mechanism 162, respectively. This adjustment will compensate for the position of the pouring basin on the particular mold. This process would be repeated for each different positioning of the pouring basin. The adjustment cylinder 160 would adjust the ladle position in a direction transverse to the path of the conveyor immediately following the pouring of the particular mold. The adjustment cylinder 167 would adjust the sensing mechanism 162 axial to the path of the conveyor immediately following the pouring of the particular mold. The two above adjustments would align the ladle 120 for the pouring of the next mold in response to the preprogrammed signal from the controller 70.

After the controller 70 has adjusted the ladle 120 and sensing mechanism 162 to insure that proper positioning of the mold pouring basin 13 will occur under the ladle pouring port 132, the controller 70 transmits a signal to the stopper mechanism 141 to raise the stopper 140 opening the nozzle 130 once the pouring basin 13 is under the pouring port 132. As the stopper 140 is raised, the molten metal begins to pour from the ladle 120 into the mold 12. As the ladle 120 begins to pour molten metal, the gantry 30 is moved by the cylinders 60 and 62 along the path of the conveyor 14 at substantially the same synchronized speed. As this occurs, the ladle 120 continues to pour molten metal into the mold 12. After a predetermined amount of molten metal has been poured into the mold 12, the controller 70 transmits a signal to lower the stopper 140 into nozzle 130 terminating the pouring of the molten metal from the ladle 120 into the mold 12. Once this occurs, the controller 70 transmits a signal to the cylinders 60 and 62 to return the gantry 30 to its original or home position. The gantry 30 returns to its original position and a signal is transmitted back to the controller 70 indicating that the gantry 30 is in its original or home position. Meanwhile, if necessary the adjustment cylinders 160 and 167 adjust the ladle 120 and sensing mechanism 162 for pouring the next mold during the return stroke of cylinders 60 and 62. The sensing mechanism 162 senses the next mold 12 and the above process is continuously repeated to fill the molds 12 on the conveyor 14.

One way the pouring profile may be input into the controller 70 is via a joystick. The operator would pour one or more molds with the joystick. Once a good pour has been achieved, the operator would signal the controller to record in memory that particular pour profile. From that point on, all subsequent molds would be poured automatically with the stored profile, from the memory of the controller. Also, a sensor could be utilized to accomplish the above process by an automated procedure eliminating the need for operator dependency.

Figure 8:
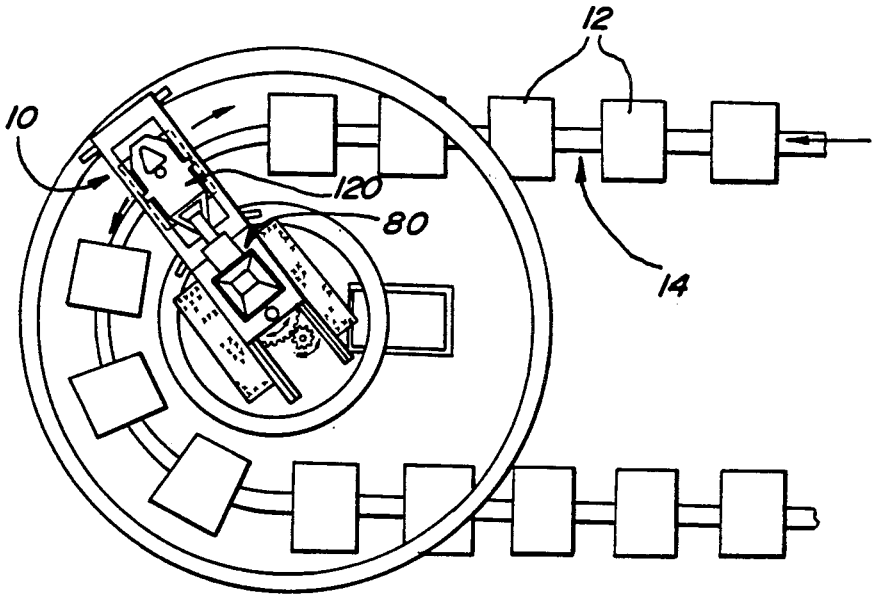
FIG. 8 is an alternate embodiment of the present invention.
Figure 7:
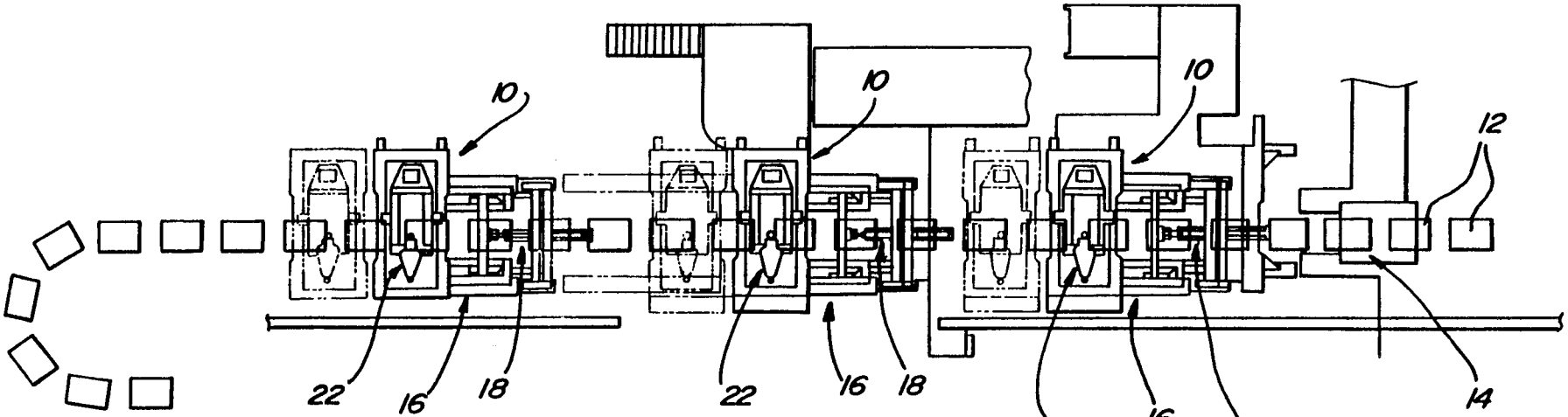
FIG. 7 is a top plan view of a plurality of pouring apparatus in according with the present invention positioned above a moving conveyor.

FIGS. 7 and 8 illustrate other embodiments of the present invention. The elements which have been previously described will be designated with the same reference numerals.

FIG. 7 illustrates a plurality of the previously described pouring apparatus placed on a car type mold conveyor. In FIG. 7, three apparatus are illustrated on the line. The number of apparatus may vary according to the speed of the conveyor and the number of molds to be poured. It should be noted that a single sensing mechanism 162 or a number of sensing mechanisms may be utilized to control the determination of the position of the molds as they move underneath the gantries.

Turning to FIG. 8, a modified pouring apparatus is illustrated at a curve portion of a car type mold conveyor. In this case, the pouring ladle portion of the apparatus would have a circular track. One or more pouring apparatus may be positioned on the circular track. Also, the pouring apparatus could reciprocate as it moved along the circular path to fill the molds. An air motor or the like mechanism would generally be utilized to drive the pouring apparatus along the arcuate path.

While the above detailed description describes the preferred embodiment of the present invention, it will be understood that the present invention is susceptible to modification, variation and change without deviating from the scope and fair meaning of the subjoined claims.

What is claimed is:

1. An apparatus for pouring molds on a continuously moving conveyor comprising:

a frame adapted to be positioned over a moving conveyor including one or more molds;

means for moving said frame in a direction along a path defined by said conveyor; and means for pouring molten metal into one or more molds on said conveyor, said pouring means associated with said frame such that said pouring means fills molds on said conveyor while moving during filing at a speed substantially equal to a speed of the conveyor enabling filling of the molds on the moving conveyor;

said pouring means includes a means for receiving molten metal from a molten metal source, a trough coupled with said receiving means for transferring the molten metal from the receiving means, a ladle on said frame for receiving molten metal from said trough, said ladle including means for releasing the molten metal from said ladle into said molds;

said receiving means is pivotal such that as said ladle moves along said conveyor path said trough pivots, continuously pouring molten metal into said ladle.

2. The apparatus according to claim 1 wherein said pouring means being adjustable in a direction transverse to the path of said conveyor.

3. The apparatus according to claim 1 further comprising means for sensing said molds such that the speed of the frame is enabled to be synchronized with the speed of the molds to pour said molds.

4. The apparatus according to claim 1 wherein said means for axially moving said frame is comprised of one or more cylinder means moving the frame in a first direction and a reverse direction and an absorber means for slowing the movement of the frame in the reverse direction.

5. The apparatus according to claim 1 further comprising means for laterally adjusting said pouring means for enabling said pouring means to align with pouring basins of said molds.

6. The apparatus according to claim 1 further comprising means for controlling movement of said frame and pouring of said molds, said controlling means being programmable to carry out said movement and pouring.

7. A system for pouring molds on a continuously moving conveyor comprising:

a plurality of frames adapted to be positioned over the moving conveyor which includes one or more molds;

means for moving each of said frames in a reciprocating direction along a path defined by said conveyor; and means for pouring molten metal into one or more molds on said conveyor, said pouring means associated with each of said frames such that said pouring means fills molds on said conveyor while moving during filling at a speed substantially equal to a speed of the conveyor enabling filling of the molds on the moving conveyor;

said pouring means includes a means for receiving molten metal from a molten metal source, a trough coupled with said receiving means for transferring the molten metal from the receiving means, a ladle on said frame for receiving molten metal from said trough, said ladle including means for releasing the molten metal from said ladle into said molds;

said receiving means is pivotal such that as said ladle moves along said conveyor path said trough pivots, continuously pouring molten metal into said ladle.

8. The system according to claim 7 further comprising means for laterally adjusting said pouring means for enabling said pouring means to align with pouring basins of said molds.

9. The system according to claim 7 further comprising means for controlling movement of each of said frames and pouring of said molds, said controlling means being programmable to carry out said movement and pouring.

10. The apparatus according to claim 7 further comprising means for sensing said molds such that the speed of each of the frames is enabled to be synchronized with the speed of the molds on the conveyor to pour said molds.

11. A device for pouring molds on a continuously moving conveyor comprising:

a movable gantry positioned over the conveyor, said gantry including a deck and members positioning said deck over the conveyor, said members coupled with a wheel means for enabling movement of the members along a surface;

cylinder means for moving said gantry axially along said conveyor, said cylinder means moving the gantry in a first direction along an axis defined by said conveyor and in a second reverse direction;

a ladle carriage associated with said deck movable in a direction transverse to movement of said gantry;

a ladle coupled with said ladle carriage for pouring molten metal from said ladle into the molds;

said cylinder means moving said gantry at a speed such that the ladle is positioned over a mold filling the mold on said conveyor while moving in synchronization therewith to pour molten metal into the mold as the mold moves along on the conveyor;

a receiver for receiving moten metal from a molten metal source, said receiver pouring molten metal into said ladle;

a trough coupled with said receiver for transporting the molten metal from the receiver to said ladle, said receiver being pivotal such that as said ladle moves along said conveyor path, said trough pivots continuously pouring molten metal into said ladle; and a controller for controlling the pouring of the ladle and movement of the gantry such that pouring of the molds is synchronized with the conveyor.

12. The device according to claim 11 further comprising means for sensing said molds such that the speed of the frame is enabled to be synchronized with the speed of the molds to pour said molds.

13. The device according to claim 11 further comprising means for laterally adjusting said ladle carriage for enabling said ladle to align with pouring basins of said molds.

14. The device according to claim 11 further comprising means for axially adjusting said ladle carriage for enabling said ladle to align with pouring basins of said molds.

15. A method for pouring molds on a movable conveyor comprising the steps of:

providing a moving conveyor with one or more molds thereon to be poured;

providing an apparatus for pouring said molds positioned over said conveyor, said apparatus including a receiving means for receiving molten metal and a ladle;

moving said apparatus along the path of said conveyor at a speed substantially equal to the speed of said conveyor;

pivoting said receiving means during movement of said apparatus to continuously pour molten metal into said ladle;

pouring molten metal from said ladle into one of said molds during movement of said apparatus as said apparatus moves along with said conveyor;

filling said one of said molds with said molten metal; and terminating pouring of said molten metal into said one of said molds.

16. The method according to claim 15 further comprising continuously repeating said steps filling a plurality of molds.

17. The method according to claim 15 further comprising reciprocating said apparatus along said conveyor to fill said molds.

* * * * *